US010212788B2

(12) United States Patent
Dünser

(10) Patent No.: US 10,212,788 B2
(45) Date of Patent: Feb. 19, 2019

(54) CENTRAL UNIT OF A BUS SYSTEM, BUS SYSTEM AND METHOD FOR LOCATING BUS SUBSCRIBERS

(71) Applicant: TRIDONIC GMBH & CO KG, Dornbirn (AT)

(72) Inventor: Mathias Dünser, Feldkirch (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 0 days.

(21) Appl. No.: 15/127,441

(22) PCT Filed: Feb. 5, 2015

(86) PCT No.: PCT/EP2015/052350
§ 371 (c)(1),
(2) Date: Sep. 20, 2016

(87) PCT Pub. No.: WO2015/139877
PCT Pub. Date: Sep. 24, 2015

(65) Prior Publication Data

US 2017/0135185 A1 May 11, 2017

(30) Foreign Application Priority Data

Mar. 20, 2014 (DE) ..... 10 2014 205 213

(51) Int. Cl.
*H05B 37/02* (2006.01)

(52) U.S. Cl.
CPC ..... *H05B 37/0254* (2013.01); *H05B 37/0227* (2013.01); *H05B 37/0272* (2013.01)

(58) Field of Classification Search
CPC ..... H05B 37/0254; H05B 37/0272; H05B 33/0857; H05B 37/0227; H04W 4/008
(Continued)

(56) References Cited

U.S. PATENT DOCUMENTS

2007/0125938 A1* 6/2007 Kikuchi ..... G01V 8/20 250/221
2008/0258646 A1 10/2008 Beij et al.
(Continued)

FOREIGN PATENT DOCUMENTS

| | | |
|---|---|---|
| DE | 102010045574 | 3/2012 |
| EP | 2434842 | 3/2012 |
| WO | 2013057626 | 4/2013 |

OTHER PUBLICATIONS

PCT Search Report in parent PCT Application PCT/EP2015/052350 dated May 12, 2015.
(Continued)

*Primary Examiner* — Wei Chan
(74) *Attorney, Agent, or Firm* — Andrus Intellectual Property Law

(57) ABSTRACT

The present invention relates to a central unit of a bus system (10), to a bus system (10) and to a method for locating bus subscribers (2) in the bus system. The central unit (1) stores a generated address list containing the addresses of the bus subscribers (2). In a commissioning mode, a control unit (3) transmits control commands to the bus subscribers (2) according to the address list. A bus subscriber (2) is preferably a luminous means or has at least one luminous display. The sequential control commands are preferably such that, at any time, a selected bus subscriber (2) assumes a first luminous state which differs from a second luminous state of all other bus subscribers (2).

9 Claims, 6 Drawing Sheets

(58) Field of Classification Search
USPC ..... 315/312, 152, 294, 320, 224, 291, 295
See application file for complete search history.

(56) References Cited

U.S. PATENT DOCUMENTS

| | | | | |
|---|---|---|---|---|
| 2010/0164402 | A1 | 7/2010 | Nieuwlands | |
| 2012/0105204 | A1* | 5/2012 | Van Beeck ..... | H05B 37/0227 340/8.1 |
| 2013/0221852 | A1* | 8/2013 | Bowers ..... | H05B 33/0863 315/131 |
| 2014/0062297 | A1* | 3/2014 | Bora ..... | H05B 33/0863 315/34 |
| 2014/0214362 | A1* | 7/2014 | Chen ..... | G01R 31/44 702/176 |
| 2014/0300276 | A1* | 10/2014 | Wang ..... | H04L 12/2807 315/151 |
| 2015/0084547 | A1* | 3/2015 | Yeh ..... | H04L 12/2807 315/312 |

OTHER PUBLICATIONS

Search report in co-pending AT Application GM 130-2014 dated Nov. 23 2015.

* cited by examiner

CENTRAL UNIT OF A BUS SYSTEM, BUS SYSTEM AND METHOD FOR LOCATING BUS SUBSCRIBERS

CROSS REFERENCE TO RELATED APPLICATIONS

The present application is the U.S. national stage application of International Application PCT/EP2015/052350, filed Feb. 5, 2015, which international application was published on Sep. 24, 2015 as International Publication WO 2015/139877 A1. The International Application claims priority to German Patent Application 10 2014 205 213.0, filed Mar. 20, 2014.

FIELD OF THE INVENTION

The present invention relates to a central processing unit of a bus system, a bus system, and a method for locating bus subscribers in the bus system. In particular, the addresses of the bus subscribers can be located such that the central processing unit, the bus system and the method of the present invention are, above all, well suited for commissioning the bus.

BACKGROUND

It is known from the prior art to locate bus subscribers, such as light sources or light sensors, in a bus system with respect to their addresses, e.g. through physical selection or through the individual playback of bus addresses.

In order to locate bus addresses, it is known, for the DALI industry standard for example, to generate an address randomly for each bus subscriber, to physically select each bus subscriber once (e.g. by removing light sources from their sockets, or shading light sensors) and in this manner to determine the address of the corresponding bus subscriber, and to assign this to a specific location.

It is further known for the DALI industry standard, to generate a random address for each bus subscriber, to select an address (manually or via a software interface) and to determine a location of the address (e.g. through observation of the change in light) through individual playback of the address (e.g. through light modulation of an address).

The known commissioning methods are extremely time consuming, however. By way of example, the random selection of all 64 bus addresses and a corresponding individual playback of the addresses for the DALI industry standard is a very time consuming procedure. Sometimes a commissioning procedure is not even possible. By way of example, physical selection is only possible when the bus subscribers are also accessible. Bus subscribers such as light sources are frequently installed, however, on a high ceiling, or have no access to the necessary interfaces.

SUMMARY OF THE INVENTION

With regard to the aforementioned disadvantages, the aim of the present invention is to improve the prior art. In particular, it is the object of the present invention to provide a central processing unit for a bus system, a bus system, and a method, with which an address location of bus subscribers of the bus system can be achieved quickly and easily. The present invention also strives to simplify and accelerate the commissioning of a bus system. Furthermore, additional costs, such as for converters or light sources should be avoided.

The aforementioned objective of the present invention is achieved by means described hereafter. In particular, a more efficient, faster and simpler location of bus subscriber addresses can be carried out with the described central processing unit, the described bus system, and the described method.

The present invention relates to a central processing unit of a bus system for locating bus subscribers, having a memory, in which an address list having the addresses of the bus subscribers is stored, and a control unit, which is configured in a commissioning mode to send sequential control commands, in accordance with the address list, to the bus subscribers.

When the central processing unit is in the commissioning mode, it is also possible to activate the bus subscribers successively, in accordance with the stored addresses. Each of the different sequential control commands preferably activates one of the addresses differently than the other addresses. By means of the effect of a specific control command on the bus subscribers, it is possible to determine the address of a specific bus subscriber. In other words, a temporal concordance of the sending of a control command with the detection of the effect of the control command on the bus subscribers is used in order to locate the address of a bus subscriber. The addresses of each bus subscriber in a bus system can be easily and quickly located with the central processing unit of the present invention.

In particular, an address location can also be carried out with the central processing unit of the present invention for bus subscribers that are not otherwise accessible. By way of example, specifically no bus subscribers need to be removed from the bus system. For example, the present invention is well suited for a bus system attached to a high building ceiling. Because the sequential control commands can be sent very quickly in accordance with all of the addresses of the address list, the address location can furthermore be carried out in a significantly shorter time.

Advantageously, a bus subscriber is a light source or has an indicator light.

The effects of the sequential control commands, which comprise, for example, different successive dimmer commands, can thus easily be visually or optically observed, or detected. A light source, for example, can be an incandescent light source, a gas discharge light source, an LED, or an OLED. A bus subscriber having an indicator light can, for example, be a sensor (such as a movement sensor, a temperature or moisture sensor, a smoke detector, a fire detector, etc.), having at least one indicator means, such as an indicator LED or a display.

Advantageously, the control unit is configured to send such sequential control commands to the bus subscribers, that at any point in time, a selected bus subscriber assumes a first illumination state, which differs from a second illumination state of all the other bus subscribers.

An illumination state can be, for example, the color or brightness of a light source or an indicator means, a lighting or blinking pattern emitted from a bus subscriber, or the brightness or color of a display.

Advantageously, an illumination state is a light output state.

A light output state for a light source or a bus subscriber with an indicator light can be easily changed with a dimmer command, and can be easily and well perceived visually or optically.

The present invention also relates to a bus system for locating bus subscribers, having a central processing unit as described above, numerous addressable bus subscribers, and a bus, preferably a DALI bus, which connects the bus subscribers to the central processing unit.

The addresses of the individual bus subscribers can be easily and quickly located in the bus system with the advantages specified above for the central processing unit.

Advantageously, the bus system also has a light sensor connected to the central processing unit, preferably connected in a unidirectional manner, which is configured to detect a light state of each bus subscriber, wherein the central processing unit is configured to temporally compare a change in the lighting state of a bus subscriber from the second to the first lighting state with a transmitted control command, in order to locate the address of the bus subscriber.

A detected change in the lighting state of a specific bus subscriber can be quickly conveyed to the central processing unit by the preferably unidirectional connection of the light sensor to the central processing unit, and synchronized with the sequential control commands, in order to establish a simultaneous control command, and by this means, to locate the address of the specific bus subscriber. Thus, the address of a specific, or numerous specific bus subscribers can be located in an extremely short time with the sequential control commands in accordance with the address list, i.e. with the successive activation of all of the addresses of the bus subscribers.

If the DALI industry standard (i.e. a DALI bus) is used as the bus, for example, all of the authorized 64 bus addresses of the DALI bus system can be successively activated in a time period of about 3.2 to 6.4 seconds. Thus, the locating of a desired bus subscriber can be nearly instantaneous, i.e. requiring a maximum waiting period in the range of a few seconds.

Advantageously, the central processing unit is configured to remove a located address from the stored address list.

This means that the located address will no longer be used for the further activation of the bus subscriber, e.g. another successive activation, and the further modulation of the light output of the bus subscriber. As a result, the address list becomes shorter for each sequential activation, and the locating of the bus subscriber addresses can be carried out or completed more quickly.

Advantageously, the central processing unit is configured to commission bus subscribers in accordance with their located addresses.

By way of example, for the commissioning, specific bus subscribers can be modified with respect to their addresses, can be assigned to logical groups, or can be entered into a building plan.

Advantageously, the first lighting state is a first light output state, and is detected for a bus subscriber by light sensors, when its light output reaches a specific threshold value, or its light output differs from the light output of all of the other bus subscribers by at least a certain threshold value.

By way of example, all bus subscribers, except for one bus subscriber for each control command, are set to a specific dimming level. The one bus subscriber is set to a different dimming level from this. If the light sensor detects this difference between the dimming levels for a selected bus subscriber, then the address of the dimmer command used at the same time is identified for this selected bus subscriber. The dimmer commands can cause a complete or partial dimming, or and increase in the light output for one bus subscriber in each case, at each point in time.

Advantageously, the threshold value is adaptively established after a successive run-through of sequential control commands in accordance with all of the addresses in the address list.

Advantageously, the light sensor is configured to be spatially assigned to each bus subscriber, and after a run-through of sequential control commands in accordance with all of the addresses of the address list, the spatially allocated bus subscriber is assigned the address according to that control command for which the light sensor has detected the strongest light output for the bus subscriber.

It may be the case that there are numerous bus subscribers in the detection range of the light sensor, even when this is spatially assigned to one bus subscriber. It is therefore advantageous to set the threshold value in an adaptive manner. By way of example, the run-through of all of the addresses occurs for this first, before the threshold value is adaptively set. Advantageously, the detection range of the light sensor can be limited to a single bus subscriber.

Advantageously, the light sensor comprises a photo sensor or a camera.

With a camera, the detection range can be limited to one bus subscriber through optical or virtual zooming. A direct selection of the detection range in a camera image without zooming is likewise conceivable, e.g. through manual interaction on a touchscreen.

Advantageously, the light sensor is a portable device, preferably a smartphone.

The important thing is that the point in time of the detection of the change in the light output of a bus subscriber can be temporally assigned precisely to the point in time of the sending of a corresponding control command. For this reason, the portable device is preferably in a wireless and/or unidirectional connection with the central processing unit, such that the point in time of the detection of the light output change can be sufficiently quickly transmitted to the central processing unit.

Advantageously, the light sensor is configured to depict located addresses of bus subscribers in a floor plan.

The floor plan can be, for example, a building plan, in which each of the bus subscribers located with an address is listed.

The present invention relates furthermore to a method for locating bus subscribers in a bus system, comprising: the generation of an address list with addresses of the bus subscribers, and the sending of sequential control commands to the bus subscribers in accordance with the address list.

Advantageously, sequential control commands of this type are sent such that at each point in time, a bus subscriber assumes a first lighting state, preferably a first light output state, that differs from a second lighting state, preferably a second light output state, of all of the other bus subscribers.

Advantageously the address list is generated by recording addresses that were permanently assigned to bus subscribers during production, or a random assignment of addresses to the bus subscribers.

Advantageously, the method further comprises: the detection of a lighting state for each bus subscriber, and to make a temporal comparison of a change of the lighting state of a bus subscriber from the second to the first lighting state with a transmitted control command, in order to locate the addresses of the bus subscribers.

The method according to the invention achieves the same advantages as those explained above for the central processing unit or the bus system. In particular, the address for each bus subscriber of a bus system can be quickly and easily located, in at least a semi-automatic manner.

BRIEF DESCRIPTION OF THE DRAWINGS

The present invention shall now be explained in detail with reference to the attached Figures.

DETAILED DESCRIPTION

Figure 1:
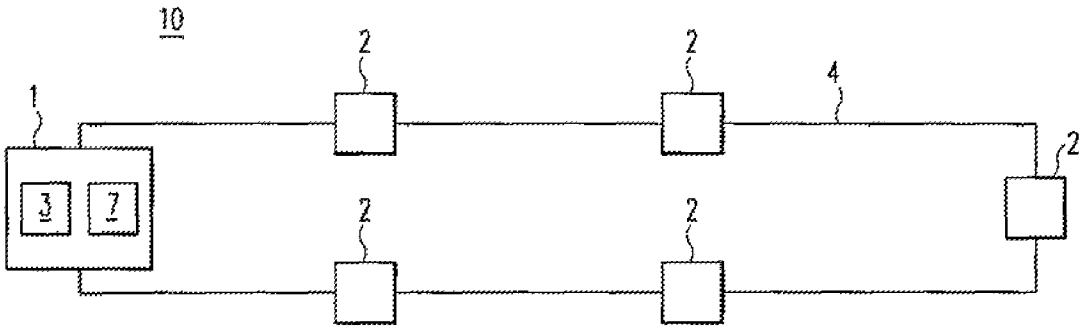
FIG. 1 shows a bus system according to an embodiment of the present invention, which comprises a central processing unit according to an embodiment of the present invention.

FIG. 1 shows the possible construction of a bus system 10 of the present invention. In particular, the bus system 10 contains a central processing unit 1 according to the invention, which can be used for locating bus subscribers 2. The bus system 10 also comprises numerous addressed bus subscribers 2, which are connected to the central processing unit 1 via a bus 4.

The central processing unit 1 of FIG. 1 comprises a memory 7, in which an address list is stored, containing the addresses of the individual bus subscribers 2 of the bus system 10. The address list does not contain, however, any information regarding the locations of the bus subscribers 2. The addresses of the address list can be permanent addresses, for example, which were already assigned to the bus subscribers 2 during production thereof. Alternatively, the central processing unit 1 can first assign each bus subscriber 2 a random address at the start of a locating procedure. If the bus 4 is a DALI bus, then there are 64 such bus addresses to be assigned.

The central processing unit 1 also comprises a control unit 3, which can function in both an operating mode as well as in a commissioning mode. In particular, the commissioning mode is important for the present invention. In the commissioning mode, the control unit 3 is designed to send control commands sequentially, in accordance with the addresses of the address list, to the bus subscribers 2.

Figure 2:
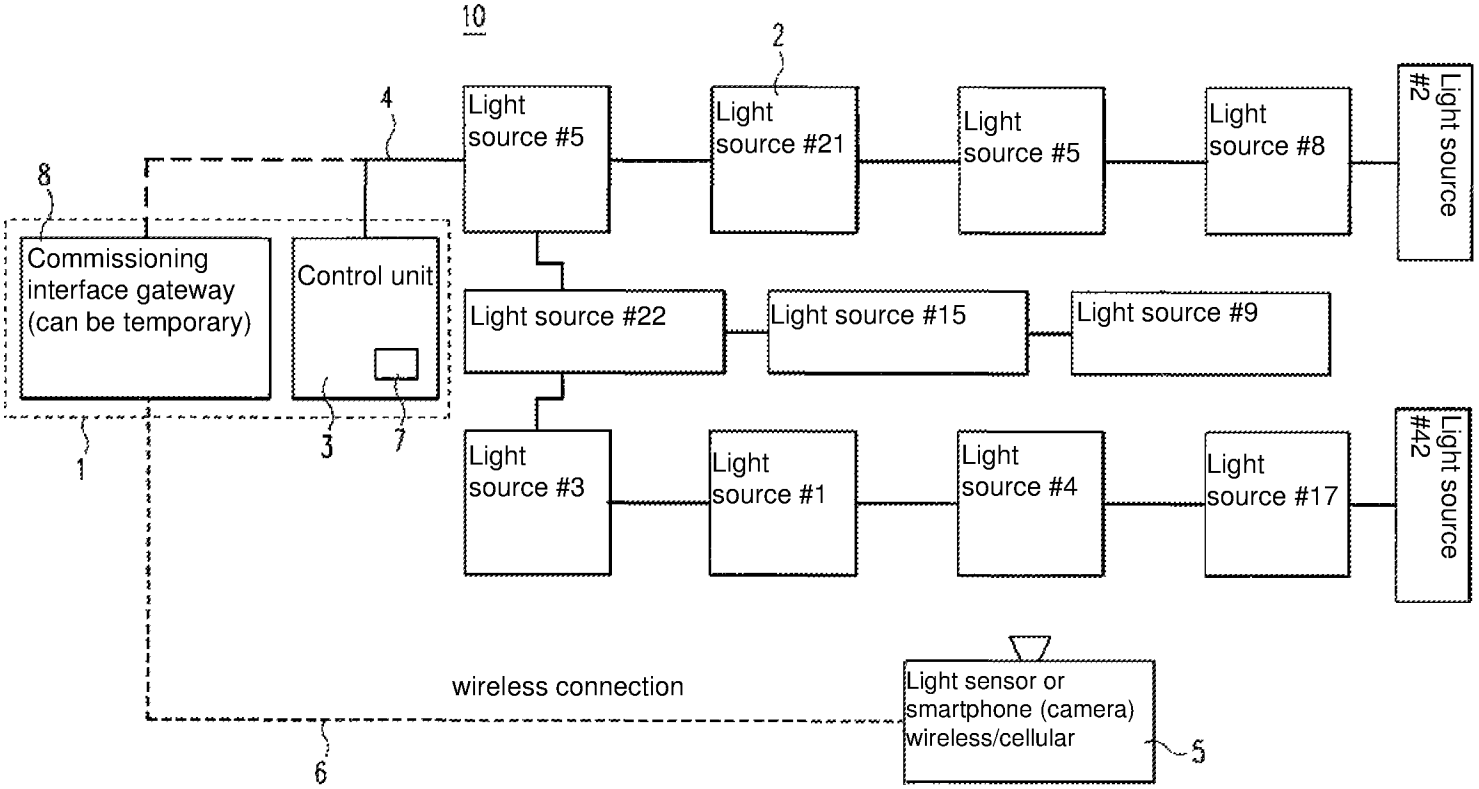
FIG. 2 shows a bus system according to an embodiment of the present invention, which comprises a central processing unit according to an embodiment of the present invention, and a light sensor.

FIG. 2 shows a concrete example of the bus system 10 from FIG. 1. The bus system 10 also then has an optional light sensor 5, which is connected to the central processing unit 1 via a preferably unidirectional communication connection. The unidirectional communication connection is preferably wireless.

In general, bus subscribers 2 can be light sources, such as gas discharge lamps, incandescent lamps, LEDs or OLEDs, and/or sensors, such as movement sensors, smoke detectors, fire detectors, water level detectors, oxygen sensors, or other subscribers, such as are typically used in building technology. The bus system 10 can be installed, for example, on the ceiling of a building. The individual bus subscribers 2 are then distributed accordingly throughout a room or a hallway. The bus subscribers 2 are preferably light sources, as shown in FIG. 2, or have at least an indicator light, such as an indicator LED or a display.

The exemplary embodiments of FIGS. 2 to 5, are primarily described below using light sources as the bus subscribers 2. As explained above, the invention is not, however, limited to such bus subscribers 2.

The central processing unit 1 preferably also has a commissioning interface 8 in FIG. 2, in order to assign bus subscribers 2 located with respect to their addresses, for example, to logical groups, to change the addresses of bus subscribers 2, or to enter these in a floor plane, such as a building plan.

The bus system 10 preferably has the light sensor 5, which can be a camera, a portable device such as a smartphone or a tablet, or a mobile photo sensor, for example. The light sensor 5 is preferably connected to the central processing unit 1 via a wireless connection, such as a WLAN network or a cellular radio network. The light sensor 5 can preferably be spatially assigned to each of the bus subscribers 2. For this, the light sensor 5 can, for example, be moved toward each bus subscriber 2, or aimed at an individual bus subscriber 2. If the light sensor 5 is a camera, for example, it can be aimed at individual bus subscribers 2, and the detection range of the camera can preferably also be limited to an individual bus subscriber 2 through zooming or through selecting a sensitive region in the detection range. Each bus subscriber 2 can thus preferably be selected by a user by walking around in a building and aiming the light sensor 5 at the bus subscribers 2.

Figure 3:
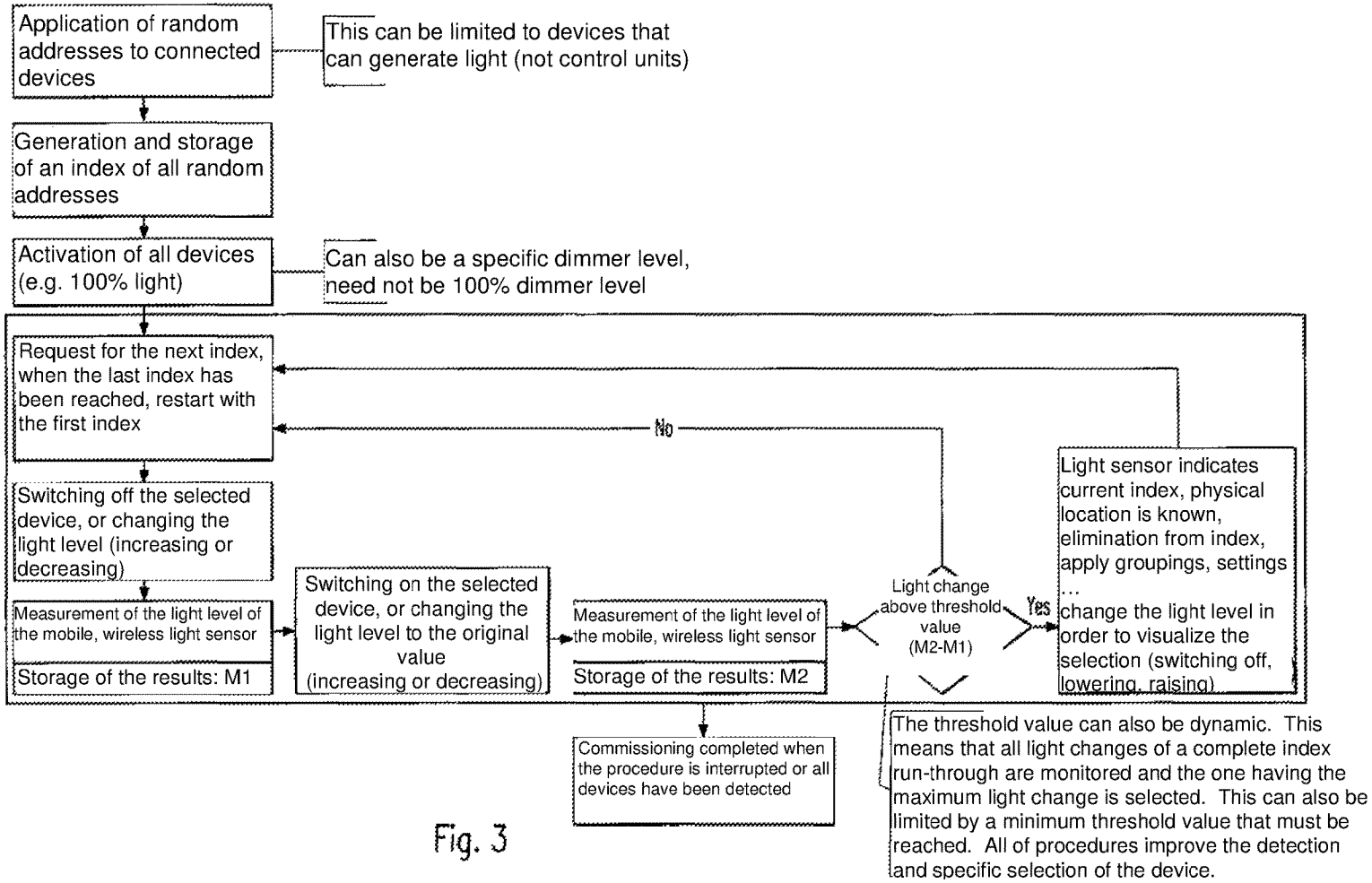
FIG. 3 shows the steps of a method according to an embodiment of the present invention.

FIG. 3 shows steps of a method according to an embodiment of the present invention. Light sources are again depicted thereby as bus subscribers 2, by way of example. The steps of the method can be executed by the central processing unit 1, or in the bus system 10 of FIGS. 1 and 2.

First, an address list having addresses of the light sources is generated by the central processing unit 1, for example. This can be carried out, for example, by assigning a random address to each light source. Alternatively, a list comprising the addresses of the individual light sources established during production can be created. The address list is subsequently stored, preferably in the memory 7 of the central processing unit 1.

All of the light sources are then preferably set to a specific output lighting state (e.g. a minimum or maximum dimmer level). Another specific dimmer level, however, can also be selected as the output lighting state.

Next, different control commands are sent sequentially to the light sources in accordance with the address list, from a central processing unit 1 for example. Preferably, each address of the address list is successively activated by the sequential control commands, such that the lighting state of the respective light source is changed for these addresses. By way of example, the lighting states of the light sources can be changed by switching off or through modulation (increasing or decreasing) of the dimmer level. The control commands activate either only one address, respectively, in order to change the lighting state of a specific light source, or they activate all of the addresses simultaneously, in order to set all of the light sources to the same lighting state, with the exception of one specific light source, which assumes a different lighting state.

The light sensor 5 is first assigned spatially to a selected light source, for example, preferably aimed at this light source. The light sensor 5 is then used to detect the lighting state of the selected light source. The light sensor 5 can preferably also be used to detect and measure numerous, or all of the light sources 5 simultaneously, and to assign their locations to a building plan.

The lighting state (e.g. the light output) of the selected light source is constantly measured by the light sensor 5 during the run-through of the addresses, and preferably a result for each transmitted control command is stored temporarily. The temporary storage can take place in the memory 7 of the central processing unit 1.

As soon as the light sensor 5 has detected a change in the lighting state of the selected light source, in particular when the difference of the preferably temporarily stored results lies above a certain threshold value, and/or reaches an absolute threshold value, an address of the selected light source can then be determined through a temporal comparison with the corresponding control command, which contains a distinct address.

Subsequently, the light sensor 5 can be aimed at the next light source, for example, and the steps described above can be repeated. The commissioning procedure is preferably complete when all of the light sources have been located with respect to their addresses. Each located address is preferably removed from the address list, such that for the next light source, fewer addresses have to be run through in order to determine its address.

Figure 4:
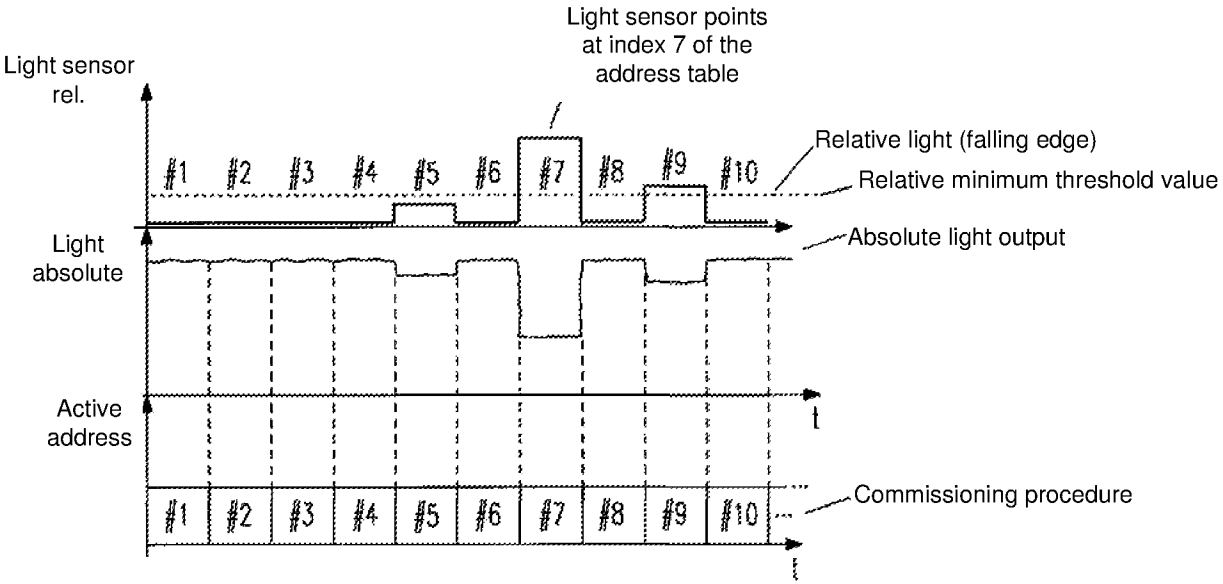
FIG. 4 shows a principle for detecting light according to an embodiment of the present invention.

FIG. 4 shows, by way of example, how a lighting state (light output here) of light sources in the bus 4 can be detected by the light sensor 5, in order to detect which address a selected light source has. It can be seen on the time axis in FIG. 4 that, for the locating procedure for example, one bus address is activated successively in each case, i.e. sequential control commands corresponding to all of the addresses in the address list can be run through. An absolute light output ("light absolute") measured by the light sensor 5 and a relative change of the light output (light sensor rel.) are plotted on the vertical axis. The light sensor 5 detects a change in the light output of the selected light source in the activated addresses #5, #7 and #9. For the addresses #5 and #9, the relative change lies above a specific threshold value. The change is greatest at address #7. The light sensor shows no significant relative change for all of the other addresses. The selected light source is preferably assigned to the address having the greatest change, and more preferably, the change must also reach a specific threshold value. Thus, in FIG. 4 the selected light source is assigned to address #7.

Figure 5:
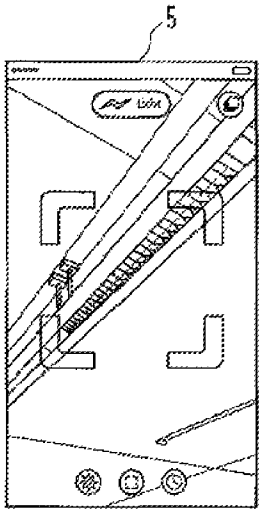
FIG. 5 shows a smartphone as the light sensor of the bus system of an embodiment of the present invention.

FIG. 5 shows a possible embodiment of the light sensor 5, specifically a smartphone having an integrated camera. A part of the bus system 10 detected by the camera is displayed on the screen of the smartphone. Thus, light sources in this part of the bus system 10 can be monitored with respect to their lighting state. Furthermore, a region can be selected, or zoomed in on, thereby, with the smartphone, in which the desired light source is located, as can be seen in the right-hand image. It is thus possible to select each light source individually and precisely, even when the light sources are packed close together, or are relatively far from the user.

A commissioning interface 8 can also be displayed directly on the smartphone. Basically, a building plan into which the light sources can be entered, can be shown on the screen thereby. Located addresses can be added thereto. Using the smartphone, an immediate commissioning of the light sources, e.g. dividing them into groups, or address changes to specific light sources, can also be carried out. Basically, at least one located light source in the building plan can be selected for this. The light sensor 5 can also be aimed at a selected light source according to the building plan. When the address of a selected light source is determined with the commissioning procedure of the present invention, this light source can be regarded as fully configured.

Figure 6:
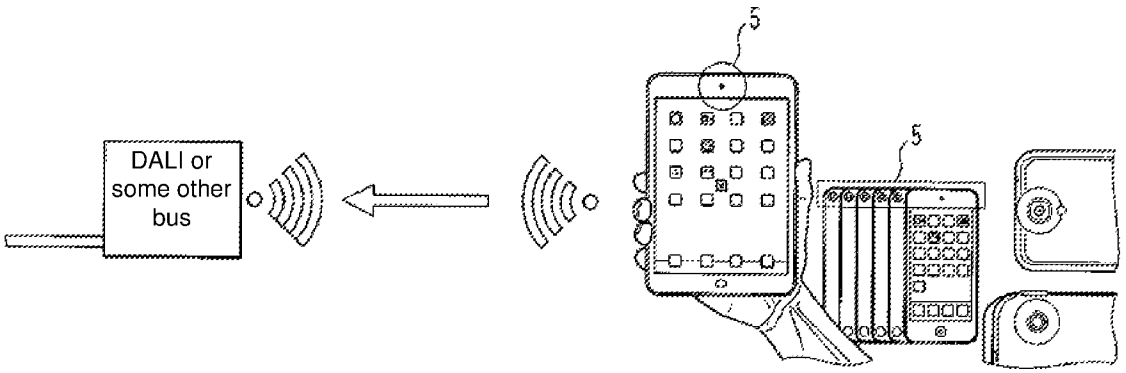
FIG. 6 shows a bus system having a portable device as the light sensor.

FIG. 6 shows, lastly, a plurality of possible portable devices that can be used as the light sensor 5, in particular a smartphone, tablet and camera. The portable device can be connected to the central processing unit 1 via a wireless interface, such as Bluetooth, Wi-Fi, infrared, GSM, 3G. The portable device can even give the user a haptic feedback, e.g. through vibration of the device, when a bus subscriber 2 has been located with respect to its address. The control of the devices can also be entirely assumed by the portable device. This only requires access to the bus 4 by the portable device. The portable device can also comprise both a central processing unit 1 and a light sensor 5. The central processing unit 1 and the light sensor 5 can thus be integrated therein.

In summary, the present invention makes it possible to quickly and easily locate a bus subscriber 2 of a bus system 10 with regard to its address. In particular, the design having a smartphone as the light sensor 5 is particularly advantageous thereby, because it can be used in many areas. Furthermore, the locating procedure of the present invention can be carried out in an inexpensive manner, and is extremely user friendly and operated in an intuitive manner.

What is claimed is:

1. A method for locating bus subscribers in a bus system, comprising the steps of;

a) storing an indexed address list in memory of a central processing, unit containing available addresses for numerous addressable bus subscribers connected to the central processing unit by a bus, each bus subscriber comprising a light source or having an indicator light;

b) activating all bus subscribers connected to a bus to a first detectable, illumination state;

c) using a mobile wireless device having a light sensor and spatially assigning the light sensor to a selected bus subscriber to sense the light output state of the selected bus subscriber when the light sensor is aimed at the selected bus subscriber;

d) transmitting, a run-through of control commands from the central processing unit to the bus subscribers, indexing sequentially in time in accordance with the indexed address list, until the selected bus subscriber is located and an address in the address list is commissioned to the located bus subscriber;

e) in response to receiving sequential control commands during the run-through, switching the bus subscriber at the indexed address to a second detectable, light output state, while other bus subscribers remain in the first light output state and then switching the bus subscriber at the indexed address back to the first light output state, wherein the second detectable, light output state is different from the first detectable, light output state;

f) sensing the light output level of the selected bus subscriber with the light sensor on the mobile device as the sequential control commands are transmitted sequentially to the bus subscribers during the run-through, and transmitting a wireless signal to the central processing unit representing that a change in the light output state of the selected bus subscriber has occurred for an assigned address index, wherein a given address index is assigned to the selected bus subscriber if the sensed light output level for the given index is greater than a specific threshold value when the selected bus subscriber is activated, if the sensed light output level for the given index is less than the specific threshold value when the selected bus subscriber is activated or if the sensed light output level for the given index differs from the light output level sensed when the other bus subscribers are activated by more than the specific threshold value;

g) when the wireless signal representing the change in the light output state of the selected bus subscriber is received by the central processing unit, commissioning the address corresponding to the assigned address index and to which the sequential control command was transmitted in step f) to the selected bus subscriber; and h) repeating steps c) through g) as necessary to commission an address for each of said bus subscribers connected to the bus.

2. The method according to claim 1, wherein the light sensor is part of the mobile device comprising one of a smartphone or a tablet that is configured with a commissioning interface to depict located addresses of the bus subscribers on a building plan in which each of the bus subscribers commissioned with an address is listed.

3. The method according to claim 1, wherein the address list is generated through the recording of addresses that were initially permanently assigned to the respective bus subscribers in production, or through a random assignment of addresses to the bus subscribers.

4. The method according to claim 1 wherein said wireless signal is transmitted to the central processing unit wirelessly via unidirectional communication.

5. The method according to claim 1, further comprising the step of removing the commissioned address from the stored, indexed address list after step g), and before repeating steps c) through g) to commission the address for the next selected bus subscriber.

6. The method according to claim 1, wherein the given address index is assigned to the selected bus subscriber if the sensed light output level for the given index differs from the light output level sensed when the other bus subscribers are activated by more than the specific threshold value and the difference when the given address index is activated is greater than the difference when other address indexes are activated.

7. The method according to claim 1, wherein the specific threshold value is adaptively set after the sequential run-through of control commands according to all of the addresses of the address list.

8. The method according to claim 1, wherein, after the run-through of the sequential control commands according to all of the addresses of the address list, the spatially assigned bus subscribers are assigned the addresses, according, to the respective control command, for which the light sensor has detected the strongest light output for the bus subscriber.

9. The method according to claim 6, wherein the specific threshold value is adaptively set after the sequential run-through of the control commands according to all of the addresses of the address list.

* * * * *